US009580878B2

(12) United States Patent
Kollbaum et al.

(10) Patent No.: US 9,580,878 B2
(45) **Date of Patent: *Feb. 28, 2017**

(54) BOLLARD COVERINGS AND METHODS OF MANUFACTURE AND USE THEREOF

(71) Applicant: Shaw Stainless, LLC, Marietta, GA (US)

(72) Inventors: Jerone R Kollbaum, Canton, GA (US); Bryan D Shaw, Powder Springs, GA (US)

(73) Assignee: Shaw Stainless, LLC, Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/174,741

(22) Filed: Jun. 6, 2016

(65) Prior Publication Data

US 2016/0319502 A1 Nov. 3, 2016

Related U.S. Application Data

(63) Continuation-in-part of application No. 14/797,609, filed on Jul. 13, 2015, now Pat. No. 9,359,730, which is a continuation of application No. 13/445,827, filed on Apr. 12, 2012, now Pat. No. 9,115,474.

(60) Provisional application No. 61/474,521, filed on Apr. 12, 2011.

(51) Int. Cl.

| | |
|---|---|
| ***E01F 15/00*** | (2006.01) |
| ***E01F 9/011*** | (2006.01) |
| ***E01F 15/14*** | (2006.01) |

(52) U.S. Cl.

CPC ..... *E01F 9/623* (2016.02); *E01F 15/003* (2013.01); *E01F 15/141* (2013.01); *E01F 15/143* (2013.01)

(58) Field of Classification Search

CPC ..... E01F 9/011

USPC ..... 116/63 R, 63 P, 63 C; 404/6, 10; 49/49; 40/607.02, 608, 607.01, 607.06, 607.07, 40/606.1, 606.01

See application file for complete search history.

(56) References Cited

U.S. PATENT DOCUMENTS

| | | | |
|---|---|---|---|
| 1,560,572 | A | 11/1925 | Hatton |
| 1,973,275 | A | 9/1934 | Babson |
| 2,121,961 | A | 6/1938 | Gill |
| 2,147,008 | A | 2/1939 | Blumenthal |
| 2,237,536 | A | 4/1941 | Wells, Jr. |

(Continued)

OTHER PUBLICATIONS

BrandSafe Protection, Bollard Safe Modular Bollard Cover, Oct. 15, 2010.

(Continued)

*Primary Examiner* — Abigail A Risic

(74) *Attorney, Agent, or Firm* — Barry E. Kaplan, Esq.

(57) ABSTRACT

A bollard covering formed from a body, a body connector, a first center, a second center, a bottom, and a top is disclosed. The body connector and bottom further comprise post guide surfaces. In order to secure the bollard covering to the post, one or more holes are provided within the bottom, threaded to accommodate a set screw, or the like. Bollard covering elements are joined by welding, bonding, or mechanical fastening. Bollard coverings may be formed from a manufacturer's standard inventory elements in order to create a standard inventory or a customized bollard covering product that may be economically configured on an individual bollard covering basis, or on small or large scale runs, with as much variation in optional components, features, and conveniences as may be required by the marketplace.

17 Claims, 11 Drawing Sheets

(56) References Cited

U.S. PATENT DOCUMENTS

| | | | |
|---|---|---|---|
| 2,286,959 | A | 6/1942 | Haines |
| 2,625,130 | A | 1/1953 | Morser |
| 2,646,638 | A | 7/1953 | Peterson |
| 3,833,804 | A | 9/1974 | Vesely |
| 4,341,488 | A | 7/1982 | Ryan |
| 4,438,484 | A | 3/1984 | Winden |
| 4,588,324 | A | 5/1986 | Goellner |
| 4,794,502 | A | 12/1988 | Guggemos |
| 4,839,782 | A | 6/1989 | Sikora |
| 4,984,139 | A | 1/1991 | Goggia |
| 4,999,749 | A | 3/1991 | Dormand |
| 5,055,987 | A | 10/1991 | Ellson et al. |
| 5,068,773 | A | 11/1991 | Toth |
| 5,072,345 | A | 12/1991 | Goggia |
| 5,075,833 | A | 12/1991 | Dormand |
| 5,251,118 | A | 10/1993 | Budnovitch et al. |
| 5,265,556 | A | 11/1993 | Hall |
| 5,397,197 | A | 3/1995 | Beavers |
| 5,500,642 | A | 3/1996 | Battle |
| 5,518,337 | A | 5/1996 | Modlin |
| 5,541,362 | A | 7/1996 | Reinert, Sr. |
| 5,594,201 | A | 1/1997 | Reinert, Sr. |
| 5,597,262 | A | 1/1997 | Beavers et al. |
| 5,599,132 | A | 2/1997 | Hughes, Jr. |
| 5,605,414 | A | 2/1997 | Fuller et al. |
| 5,608,994 | A | 3/1997 | Carter |
| 5,628,558 | A | 5/1997 | Iacono et al. |
| 5,785,409 | A | 7/1998 | Reinert, Sr. |
| 5,829,913 | A | 11/1998 | Puckett |
| 5,908,262 | A | 6/1999 | Ahn |
| 6,045,236 | A | 4/2000 | Cheng et al. |
| 6,071,037 | A | 6/2000 | Holt |
| 6,183,112 | B1 | 2/2001 | Bomas |
| 6,256,961 | B1 | 7/2001 | Byrnes |
| 6,341,877 | B1 | 1/2002 | Chong |
| 6,402,337 | B1 | 6/2002 | Le Vasseur et al. |
| 6,769,833 | B2 | 8/2004 | Dicke et al. |
| 6,945,730 | B1 | 9/2005 | Lobban |
| 7,325,998 | B2 | 2/2008 | Leonhardt et al. |
| 7,614,143 | B2 | 11/2009 | Seff et al. |
| 8,376,650 | B2 | 2/2013 | Hild et al. |
| 9,115,474 | B2 | 8/2015 | Kollbaum et al. |
| 9,359,730 | B2 | 6/2016 | Kollbaum et al. |
| 2002/0056251 | A1 | 5/2002 | Venegas, Jr. |
| 2002/0178994 | A1 | 12/2002 | Fernandez Marin |
| 2007/0278466 | A1 | 12/2007 | Venegas, Jr. |
| 2010/0031546 | A1 | 2/2010 | Nwatu |
| 2012/0090207 | A1 | 4/2012 | Johnston |

OTHER PUBLICATIONS

BrandSafe Protection, Bollard Safe Bollard Cover Kit, Jun. 30, 2013.

FIG. 5C
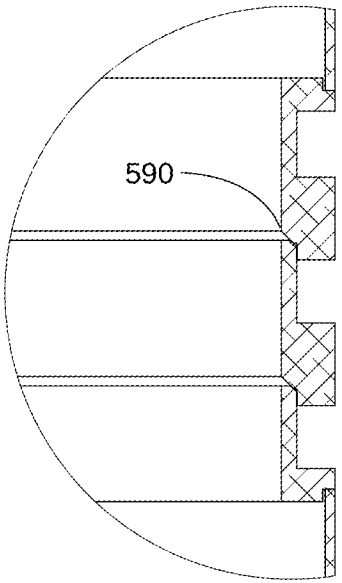
FIG. 5B
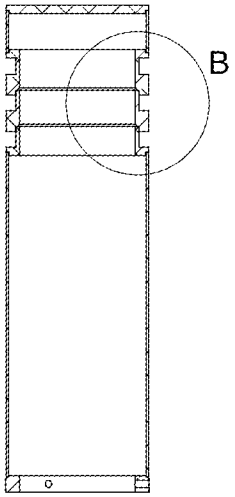
FIG. 5A
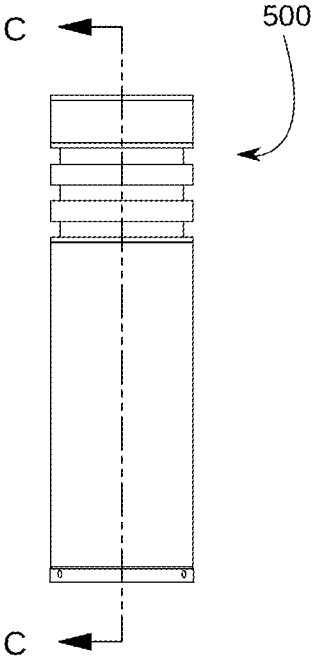
FIG. 5

FIG. 6C
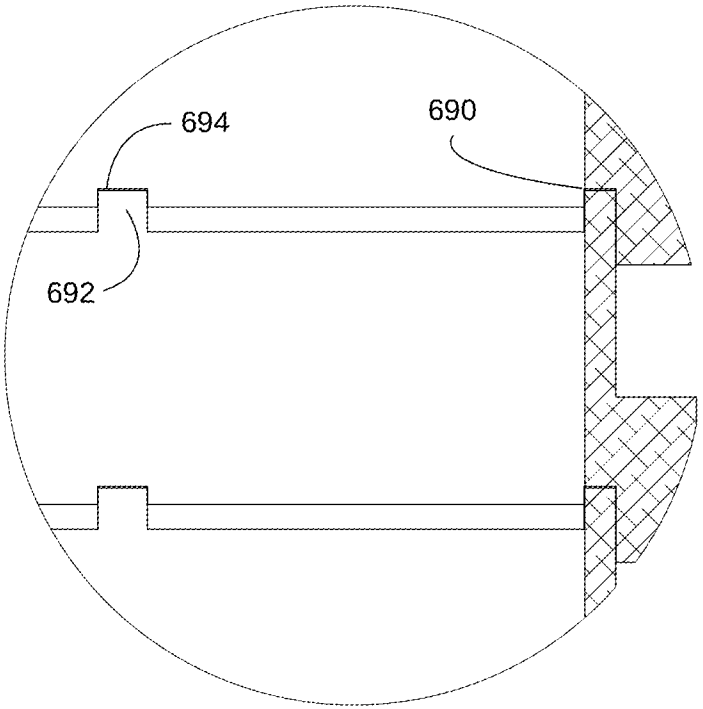
FIG. 6B
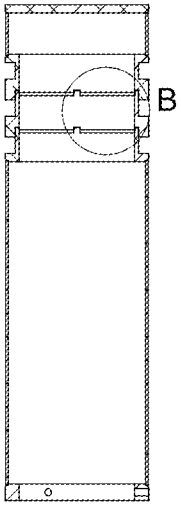
FIG. 6A
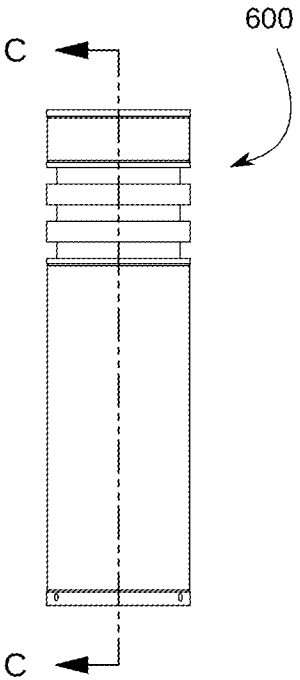
FIG. 6

FIG. 7C
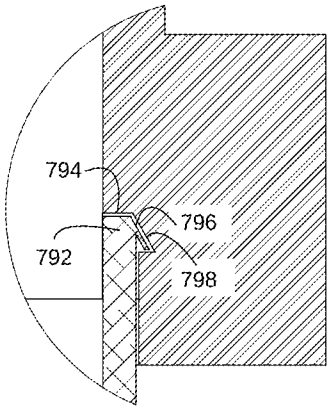
FIG. 7B
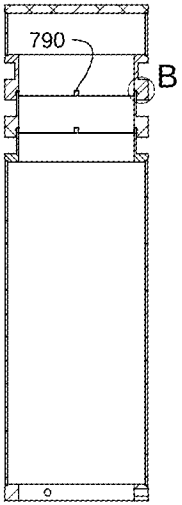
FIG. 7A
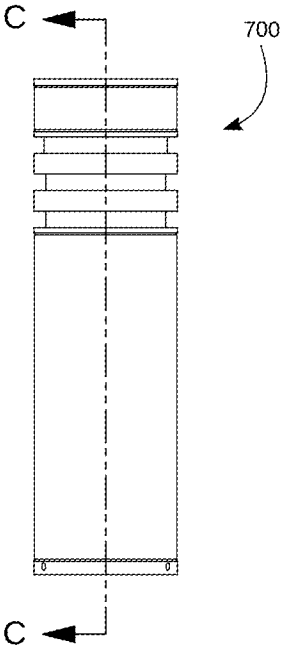
FIG. 7

FIG. 8C
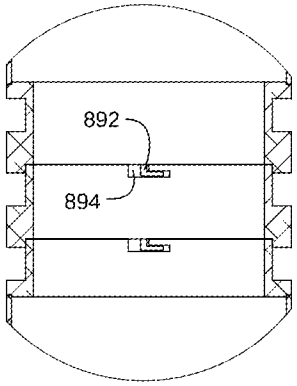
FIG. 8B
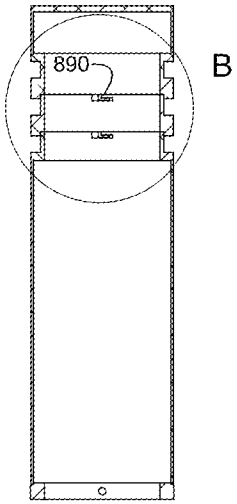
FIG. 8A
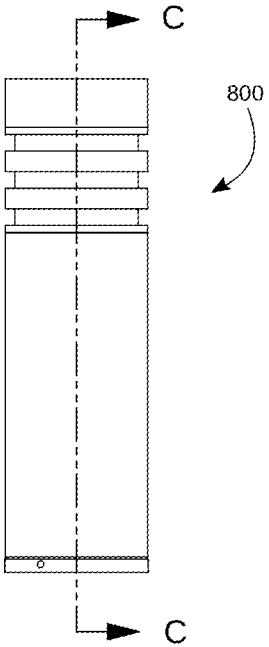
FIG. 8

FIG. 9C
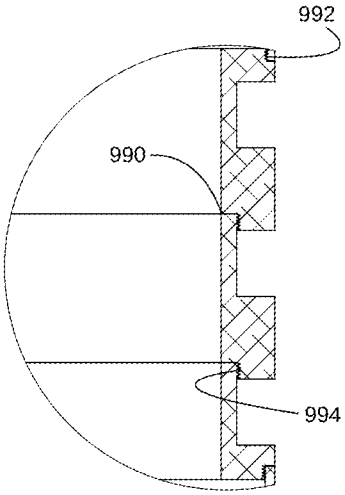
FIG. 9B
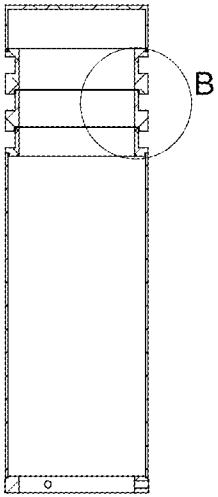
FIG. 9A
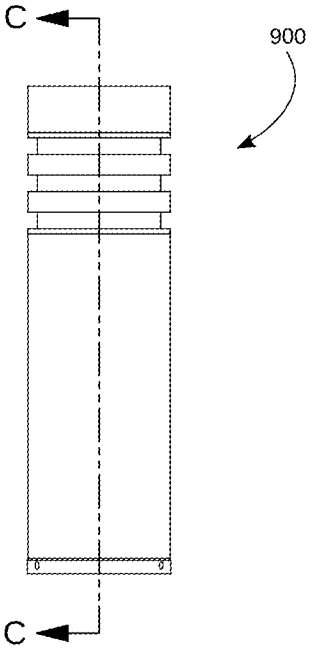
FIG. 9

BOLLARD COVERINGS AND METHODS OF MANUFACTURE AND USE THEREOF

CROSS-REFERENCE TO RELATED APPLICATIONS

This United States non-provisional patent application is a continuation-in-part of U.S. non-provisional patent application Ser. No. 14/797,609, filed on Jul. 13, 2015, now U.S. Pat. No. 9,359,730, issued on Jun. 7, 2016, which was continuation of, and claimed priority to and full benefit of, U.S. non-provisional patent application Ser. No. 13/445,827, filed on Apr. 12, 2012, now U.S. Pat. No. 9,115,474, issued on Aug. 25, 2015, which claimed priority to and full benefit of U.S. provisional patent application Ser. No. 61/474,521, filed on Apr. 12, 2011, each of which is incorporated by reference herein in its entirety.

TECHNICAL FIELD

The technical field of the present invention relates, generally, to barricade and barrier devices; and, more particularly, to barricade and barrier devices in the nature of bollard coverings, the bollard coverings of the present invention being uniquely constructed and configured, and to methods of manufacture and use of said bollard coverings.

BACKGROUND

A bollard is a rigid, vertical post. Originally used on piers, wharves, or quays for mooring ships and other watercraft, bollards have taken on an expansive role in modern society. Today, bollards are most often used as barricade and barrier devices for outdoor perimeter defense and traffic control.

When used for outdoor perimeter defense of buildings or other structures, bollards are most often arranged in linear or curvilinear, multi-unit formations, which are sized and spaced-apart sufficiently to allow certain kinds of vehicles and/or traffic (e.g., small maintenance or other special purpose vehicles, carts, bicycles, and/or pedestrians) to pass, while denying or limiting others (e.g., cars, trucks, and/or larger equipment). Similarly, bollards may be used as barrier devices to guard landscape, statues, statuaries, and the like.

Bollards may also be used as interior barrier devices to prevent vehicles and/or other movable objects (e.g., forklifts, luggage, grocery carts, and the like) from coming into contact with doorways, garages, portals, refrigerators/freezers, warehouse shelving and pallets, cargo docks, and other objects or framed openings.

Bollards often are used as traffic control barrier devices. They may be arranged to designate traffic lanes, to define pedestrian pathways, to define parking areas, and the like. They may also provide, by virtue of their height and stature, a visible means for warning operators of cars and trucks against inadvertent contact with proximate obstacles and/or hazardous objects.

In addition to fixed bollards, some designs are created for ease of replacement or reconfiguration of the bollard in its location of use. There exist rising and/or retractable bollards for enforcing traffic rules that are time-related, or for restricting access to particular classes of traffic. There are removable bollards which allow access to otherwise restricted areas by service and emergency vehicles. There are robotic bollards capable of moving themselves into a position of use, and self-righting bollards that can return to upright position after contact with a vehicle.

Sometimes, it is desirable to produce a bollard in a post-like, columnar configuration, often uniformly sized and/or shaped. With such configuration, it may also be desirable to provide a crash-rated bollard over-covering, also known as a bollard covering, bollard skin, or bollard sleeve, that may comprise any of a variety of selected design, aesthetic, or functional features. In such event, the bollard covering is enabled to slide over the columnar bollard and attach thereto. Such bollard coverings allow for convenient repair and replacement, whether because of damage or for aesthetic reasons, without disturbing the underlying bollard.

As may be imagined from the above descriptions, bollards and bollard coverings are commonly available in diverse heights, sizes, shapes, materials, designs, and configurations, the particular selection of which may be influenced by those desirable characteristics matching the intended application and/or use. In some configurations, bollards and bollard coverings may comprise surfaces having sections falling in relief below an outer, sometimes contoured, surface, often taking the form of slots, ridges, grooves, or the like. Such features typically are located near the top of the bollard or bollard covering; for example, in the top third of the above-ground height measurement.

Additionally, in support of the various uses and applications to which a bollard may be put, modern bollards and/or bollard coverings may be provided with any of a variety of options and conveniences. As can be seen in the following examples, the variety of uses and applications for bollard products is seemingly endless. For example, modern bollards and/or bollard coverings may be fitted with incandescent lights or light emitting diodes ("LEDs") for purposes of lighting pathways or drawing attention to the location of the bollard during low light conditions, such as at night or in adverse weather. They may be fitted with coverings to prevent denting and scratching of either the bollard or a contacting object. They may be provided with decorative caps, such as pyramidal, round, flat, or other shapes; or with functional caps, such as T-tops for affixing tape for delineation of motorways, pedestrian walkways, or the like. Bollards and/or bollard coverings may be fitted with audio speakers and supporting components in order to enhance outdoor ambiance. They may be fitted with cameras and supporting components in order to support security objectives. They may have integral light reflectors, may be finished with light reflective coatings, or may carry light reflective tape or bands, all for enhanced visibility during low light conditions. Bollards may be fitted with switch or button apparatus for pedestrian crosswalk right-of-way requests. In many bollard and/or bollard covering configurations, such optional components, features, and conveniences may be located within, or associated with, the surface relief features discussed above. For example, lights, reflective elements, or speaker components may be associated with one or more grooves or slots disposed near an upper surface of the bollard and/or bollard covering.

Bollards and bollard coverings are manufactured from materials most often including metals, such as iron, steel, aluminum, and non-ferrous metal alloys; concrete; fiberglass; and plastic. Selection of the material from which to fabricate a particular bollard product is, of course, dependent upon the intended use and application to which the bollard product will be put, along with the ease of configuring the bollard and/or bollard covering to accommodate and/or accept any required optional components or features.

Most often, metallic bollards and bollard coverings are manufactured from prefabricated pipe or metal castings.

During manufacture of a bollard or bollard covering from a pipe or casting, the bollard product must often be put through secondary forming processes, such as one or more cutting, welding, and/or machining processes. Such processes might be required, for example, in order to provide mounting surfaces amenable for affixing the bollard to an in-ground or above ground mounting feature, and to provide surface relief and configuration features, such as those discussed above, in order to accommodate optional components or features.

Disadvantageously, such secondary forming processes most often must be customized to accommodate the particular requirements of each various bollard design, size, or configuration progressing through a manufacturing line or process. Set-up costs and manufacturing inefficiencies occasioned by frequent bollard and/or bollard covering design or configuration changes may significantly increase manufacturing costs. Alternatively, for the sake of manufacturing cost efficiencies, bollard and/or bollard covering design or configuration may be limited by a manufacturer to only certain highly saleable products. Yet additionally, when large runs of a particular bollard product are undertaken by a manufacturer for the sake of production economies of scale, warehousing, inventory, and storage costs, along with associated cost of goods on-hand and taxes, may be significantly increased by having to keeping a large number of products and/or product skews in inventory to serve the marketplace.

Accordingly, in order to overcome at least some of the above-noted deficiencies in the prior art, and to meet at least some of the attendant needs recognized, it would be beneficial to provide bollard coverings fabricated according to a unique modular design and construction. Availability of a unique modular design and construction for such bollard covering products would provide for greater manufacturing efficiencies, and would allow an enhanced diversity and greater number of bollard covering products to be available in the marketplace. Use of such unique modular design and construction for bollard covering products would allow for greater numbers of customer-required configurations and more options, greater design flexibility, and lower costs, all of which would be beneficial in providing those features, functions, and uses demanded in the modern marketplace, and at a more efficient price. It is, thus, to the provision of such unique modular design and construction for bollard covering products, and associated methods of use thereof, that the present invention is directed.

SUMMARY

Briefly described, in the exemplary embodiments, the subject matter of the present invention is directed to a bollard covering comprising a body, a body connector, a first center, a second center, and a top. Joined to the body at a lower end is a bottom. The body connector and bottom further comprise post guide surfaces to guide and to concentrically locate the bollard covering upon a post, and to provide structural stability of the bollard covering in association with the post. In order to secure the bollard covering to the post, and to restrict loosening and/or removal of the bollard covering from its post, one or more hole is provided within the bottom. The hole may be threaded to accommodate a set screw, or may be otherwise configured to accept a pin, screw, bolt, or the like.

The method of the present invention contemplates that such elements may be joined by simple and relatively inexpensive secondary operations, such as welding, bonding, mechanical fastening (including, without limitation, screws, screw and/or threaded elements, frictional, compression, and/or press-fit elements, adhesives and/or adhesive elements, weldments, bolts and nuts, pins, threaded collars and/or cooperating threaded recesses, interlocking tab and slot arrangements, interlocking mechanical element and slot arrangements, and the like), and other known forms of joining together cooperating mechanical elements, from a manufacturer's standard inventory elements, in order to create a standard inventory or a customized bollard covering product that may be economically configured on an individual bollard covering basis, or on small or large scale runs, with as much variation in optional components, features, and conveniences as may be required by the marketplace, and without excessive setup or secondary machining/processing costs associated with bollard covering manufacturing processes for an individual bollard covering product, or with runs of a particular bollard covering product.

These and other aspects of the inventive subject matter will become apparent to those ordinarily skilled in the art after reading the following Detailed Description and Claims in light of the accompanying drawing Figures.

BRIEF DESCRIPTION OF THE DRAWINGS

The following specification is best read in conjunction with the accompanying drawing Figures, in which like reference numbers throughout the various drawing Figures designate like structure, and in which:

FIG. 5A depicts a side elevation view of a fifth embodiment of the present invention;

FIG. 5B depicts a sectional view of the embodiment of FIG. 5A taken at section C-C;

FIG. 5C depicts a sectional view of the embodiment of FIG. 5A taken at section B;

FIG. 6A depicts a side elevation view of a sixth embodiment of the present invention;

FIG. 6B depicts a sectional view of the embodiment of FIG. 6A taken at section C-C;

FIG. 6C depicts a sectional view of the embodiment of FIG. 6A taken at section B;

FIG. 7A depicts a side elevation view of a seventh embodiment of the present invention;

FIG. 7B depicts a sectional view of the embodiment of FIG. 7A taken at section C-C;

FIG. 7C depicts a sectional view of the embodiment of FIG. 7A taken at section B;

FIG. 8A depicts a side elevation view of an eighth embodiment of the present invention FIG. 8B depicts a sectional view of the embodiment of FIG. 8A taken at section C-C;

FIG. 8C depicts a sectional view of the embodiment of FIG. 8A taken at section B; and, FIG. 9A depicts a side elevation view of a ninth embodiment of the present invention;

FIG. 9B depicts a sectional view of the embodiment of FIG. 9A taken at section C-C;

FIG. 9C depicts a sectional view of the embodiment of FIG. 9A taken at section B.

Figure 1B:
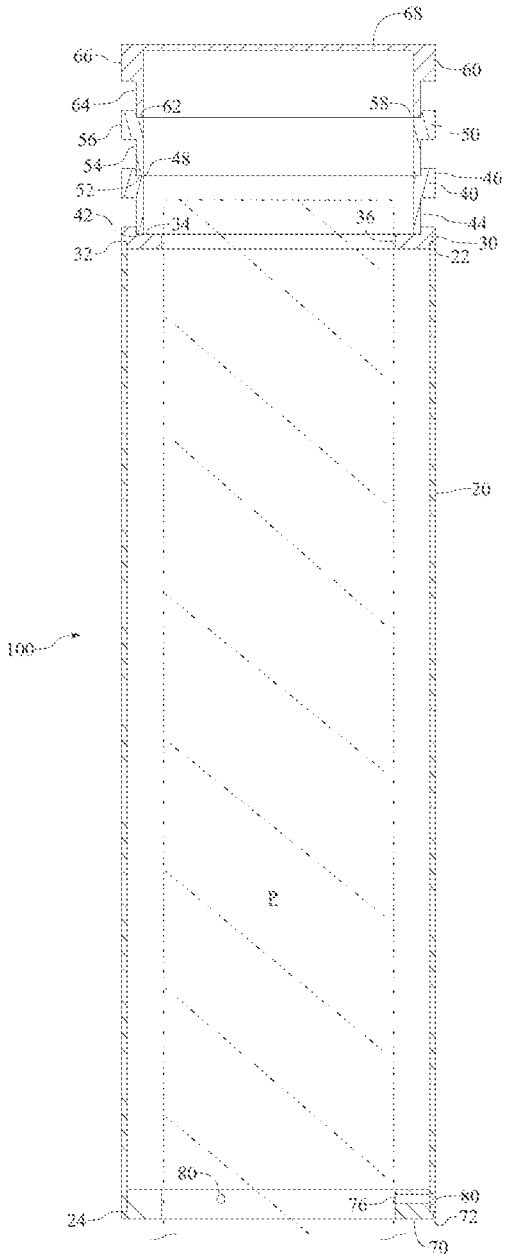
FIG. 1B depicts a sectional view of the embodiment of FIG. 1A taken at section C-C.

It is to be noted that the drawing Figures presented are intended solely for the purpose of illustration and that they are, therefore, neither desired nor intended to limit the subject matter of the claimed to any or all of the exact details of construction shown, except insofar as they may be deemed essential to that which is claimed.

DETAILED DESCRIPTION OF ILLUSTRATIVE EMBODIMENTS

Exemplary embodiments of bollard coverings designed, configured, and fabricated in accordance with the present inventive subject matter are shown in the drawing Figures and are described in greater detail herein. It will be recognized that, in describing preferred and alternate embodiments of the subject matter of the present disclosure, as illustrated in the Figures, specific terminology is employed for the sake of clarity. The disclosed and claimed subject matter, however, is not intended to be limited to the specific terminology so selected, and it is to be understood that each specific element includes all technical equivalents that operate in a similar manner to accomplish a similar purpose.

Turning to the drawings, FIGS. 1A-D depict bollard covering 100 of the present invention according to a preferred embodiment. In this exemplary embodiment, bollard covering 100 is fabricated of a metal or a metal alloy, and may comprise any shape or configuration. Exemplary shapes may comprise round, rectangular, square, oval, and/or other geometric shapes, and combinations thereof. For illustrative purpose only, and without limiting the inventive subject matter disclosed herein, suitable metals and metal alloys may comprise iron, steel, aluminum, and non-ferrous metal alloys; however, it will also be recognized that other materials, such as concrete, plastic, fiberglass, or composites, may be utilized in an appropriate case. Selection of the material from which to fabricate a particular bollard covering product is, of course, dependent upon the intended use and application to which the bollard covering product will be put, along with the ease of configuring the bollard covering to accommodate and/or accept any required optional components or features. Thus, other and further materials may certainly be used when appropriate to the design, use, and/or intended application. Use of any and all such materials is, therefore, contemplated within this disclosure.

With continued reference to FIGS. 1A-D, and generally described, bollard covering 100 comprises body 20. Joined to body 20 at an upper end is body connector 30, also sometimes called a body mounting plate. Joined to body connector 30 is first center 40. Joined to first center 40 is second center 50. Joined to second center 50 is top 60. Similarly, joined to body 20 at a lower end is bottom 70.

In greater detail, and as best seen with specific reference to FIG. 1B, body 20 is preferably of hollow cylindrical cross-section. Body 20 preferably comprises such hollow interior for the purposes and reasons set forth more fully below; however, in other embodiments, body 20 may comprise a solid interior. For manufacturing efficiency, it will be appreciated that body 20 is preferably fabricated from a preformed, tubular stock material, such as pipe, pipe section, casting, or casting section, or may be formed by rolling, hydroforming, metal spinning, stamping, and/or the like. According to the present invention, body 20 is prefabricated to a desired contour, length, outside diameter, wall thickness or inside diameter, and/or any other related specifications as may be suitable to the design, use, and/or application. If necessary, however, body 20 may be shortened or otherwise reconfigured from an as-designed or predetermined dimension to a preferred or stock dimension by any of a variety of processes, including sawing, cutting, milling, lathing, grinding, or the like, all such processes being well-known in the art.

Body 20 comprises upper end 22 and lower end 24. Affixed at upper end 22 is body connector 30. Body connector 30 is preferably of hollow, modified cylindrical cross-section. For manufacturing efficiency, it will be appreciated that body connector 30 is preferably fabricated from a preformed, tubular stock material, such as pipe or pipe section, or from a preformed, modified tubular stock material, such as a casting, or casting section. Alternative constructs are, however, contemplated within the present disclosure, such as may be formed from multiple sections or segments of material joined together in such form and fashion so as to be equivalent to the construction of body connector 30 as set forth herein.

According to the present invention, body connector 30 is prefabricated to a desired contour, thickness, outside diameter, wall thickness or inside diameter, and/or any other related specifications as may be suitable to the design, use, and/or application. If necessary, however, body connector 30 may be modified from an as-designed or predetermined dimension to a preferred or stock dimension by any of a variety of processes, including sawing, cutting, milling, lathing, grinding, or the like, all such processes being well-known in the art.

Body connector 30 comprises lip or flange surface 32. When assembled to body 20, flange surface 32 bears against and is joined to upper end 22 of body 20. Formed within body connector 30 is recess 34. Recess 34 is suitably dimensioned so as to receive a cooperating and mating lower end 42 of first center 40. Also formed within body connector 30 is post guide surface 36, the purpose and use of which will be described in greater detail more fully below.

First center 40 is preferably of hollow, modified cylindrical cross-section. For manufacturing efficiency, it will be appreciated that first center 40 is preferably fabricated from a preformed, tubular stock material, such as pipe or pipe section, or from a preformed, modified tubular stock material, such as a casting, or casting section. Alternative constructs are, however, contemplated within the present disclosure, such as may be formed from multiple sections or segments of material joined together in such form and fashion so as to be equivalent to the construction of first center 40 as set forth herein.

According to the present invention, first center 40 is prefabricated to a desired contour, thickness, outside diameter, wall thickness or inside diameter, and/or any other related specifications as may be suitable to the design, use, and/or application. As set forth above, first center 40 comprises lower end 42. When assembled to body connector 30, lower end 42 bears against and is joined to recess 34.

As was described above, bollard coverings may, in some embodiments, comprise surfaces having sections falling in relief below an outer, sometimes contoured, surface, often taking the form of slots, ridges, grooves, or the like. In the embodiment shown in FIGS. 1A-C, for example, first center 40 may comprise relief surface 44 and contour surface 46. As with the other bollard covering portions described above, if necessary, relief surface 44 and/or contour surface 46 of first center 40 may be modified from an as-designed or predetermined dimension to a preferred or stock dimension by any of a variety of processes, including sawing, cutting, milling, lathing, grinding, or the like, all such processes being well-known in the art.

Formed within first center 40 is recess 48. Recess 48 is suitably dimensioned so as to receive a cooperating and mating lower end 52 of second center 50.

Second center 50 is preferably formed of a structure similar to that which was described hereinabove with respect to first center 40. That is, second center 50 is preferably of hollow, modified cylindrical cross-section. For manufacturing efficiency, it will be appreciated that second center 50 is preferably fabricated from a preformed, tubular stock material, such as pipe or pipe section, or from a preformed, modified tubular stock material, such as a casting, or casting section. Alternative constructs are, however, contemplated within the present disclosure, such as may be formed from multiple sections or segments of material joined together in such form and fashion so as to be equivalent to the construction of second center 50 as set forth herein.

Second center 50 is prefabricated to a desired contour, thickness, outside diameter, wall thickness or inside diameter, and/or any other related specifications as may be suitable to the design, use, and/or application. As set forth above, second center 50 comprises lower end 52. When assembled to first center 40, lower end 52 bears against and is joined to recess 48.

For the reasons described above with regard to first center 40, second center 50 may comprise relief surface 54, also known as a reveal, and contour surface 56, also known as an accent or accent band. As with the other bollard covering portions described above, if necessary, relief surface 54 and/or contour surface 56 of second center 50 may be modified from an as-designed or predetermined dimension to a preferred or stock dimension by any of a variety of processes, including sawing, cutting, milling, lathing, grinding, or the like, all such processes being well-known in the art.

Formed within second center 50 is recess 58. Recess 58 is suitably dimensioned so as to receive a cooperating and mating lower end 62 of top 60.

Before moving on to describe top 60 in greater detail, it is here noted, and as will be apparent to one of ordinary skill in the art, that centers 40, 50 of any of the above-described embodiments may be configured and used as described in association with a bollard covering of the present invention; however, variants are possible. For example, in some embodiments, a bollard covering of the present invention may omit one or both of centers 40, 50. In some embodiments, a bollard covering of the present invention may comprise two or more of either or both of centers 40, 50. Centers 40, 50 may take other, further, or differing designs, shapes, sizes, constructs, and the like, from one another and from the specific embodiments described.

Now describing top 60, except for such differences as will be described in greater detail herein, top 60 is preferably formed of a structure similar to that which was described hereinabove with respect to centers 40, 50. That is, top 60 is preferably of hollow, modified cylindrical cross-section. For manufacturing efficiency, it will be appreciated that top 60 is preferably fabricated from a preformed, tubular stock material, such as pipe or pipe section, or from a preformed, modified tubular stock material, such as a casting, or casting section. Alternative constructs are, however, contemplated within the present disclosure, such as may be formed from multiple sections or segments of material joined together in such form and fashion so as to be similar to the construction of top 60 as set forth herein.

Top 60 is prefabricated to a desired contour, thickness, outside diameter, wall thickness or inside diameter, and/or any other related specifications as may be suitable to the design, use, and/or application. As set forth above, top 60 comprises lower end 62. When assembled to second center 50, lower end 62 bears against and is joined to recess 58.

For the reasons described above with regard to centers 40, 50, top 60 may comprise relief surface 64 and contour surface 66. As with the other bollard covering portions described above, if necessary, relief surface 64 and/or contour surface 66 of top 60 may be modified from an as-designed or predetermined dimension to a preferred or stock dimension by any of a variety of processes, including sawing, cutting, milling, lathing, grinding, or the like, all such processes being well-known in the art.

Rather than having a recess formed within an upper end of top 60, as was the case with centers 40, 50, top 60 comprises, in this exemplary embodiment, flat surface 68. Flat surface 68 comprises the uppermost surface of bollard covering 100.

As has been described above, in support of the various uses and applications to which a bollard covering may be put, modern bollard coverings may be provided with any of a variety of options and conveniences, such as incandescent lights or light emitting diodes ("LEDs") for purposes of lighting pathways or drawing attention to the location of the bollard covering during low light conditions, such as at night or in adverse weather; audio speakers and supporting components in order to enhance outdoor ambiance; cameras and supporting components in order to support security objectives; integral light reflectors; light reflective coatings; light reflective tape or bands; switch or button apparatus for pedestrian crosswalk right-of-way requests; and the like. In some bollard covering embodiments, such optional components, features, and conveniences may be located within, or associated with, for example, one or more of centers 40, 50, top 60, relief surfaces 44, 54, 64, and/or contour surfaces 46, 56, 66.

That is, the hollow interiors of centers 40, 50 and/or top 60 may house or otherwise accommodate any such optional components, features, and conveniences that should be shielded from view or the environment, while relief surfaces 44, 54, 64 and/or contour surfaces 46, 56 may carry, display, house, or otherwise accommodate any components, features, and conveniences that require viewing from or interaction with the outside environment.

Now, with continued reference to the Figures, affixed at lower end 24 of bollard covering 100 is bottom 70. Bottom 70 is preferably of hollow, modified cylindrical cross-section. For manufacturing efficiency, it will be appreciated that bottom 70 is preferably fabricated from a preformed, tubular stock material, such as pipe or pipe section, or from a preformed, modified tubular stock material, such as a casting, or casting section. Alternative constructs are, however, contemplated within the present disclosure, such as may be formed from multiple sections or segments of material joined together in such form and fashion so as to be equivalent to the construction of bottom 70 as set forth herein.

According to the present invention, bottom 70 is prefabricated to a desired contour, thickness, outside diameter, wall thickness or inside diameter, and/or any other related specifications as may be suitable to the design, use, and/or application. If necessary, however, bottom 70 may be modified from an as-designed or predetermined dimension to a preferred or stock dimension by any of a variety of processes, including sawing, cutting, milling, lathing, grinding, or the like, all such processes being well-known in the art.

Bottom 70 comprises lip or flange surface 72. When assembled to body 20, flange surface 72 bears against and is joined to lower end 24 of body 20. Formed within bottom 70 is post guide surface 76, the purpose and use of which will be described in greater detail more fully below.

With continuing reference to FIG. 1B, in many common uses and applications, bollard covering 100 may be fitted over a user-provided and/or installed post P. Post P most often comprises a rigid, cylindrical material, such as steel or concrete. Post P is installed into a ground surface, a preformed pad, or a subsurface support structure at the location where bollard covering 100 is to be installed. During installation, bollard covering 100 is fitted over post P and secured thereto, often in the manner next described.

In order to guide and to concentrically locate bollard covering 100 upon post P, and to provide structural stability of bollard covering 100 in association with post P, post guide surfaces 36, 76 are provided. Bollard covering 100 receives post P through post guide surfaces 36, 76, and bottom 70 typically rests on a ground surface, a preformed pad, or a subsurface support structure.

In order to secure bollard covering 100 to post P, and to restrict loosening and/or removal of bollard covering 100 from post P, provided in bottom 70 is one or more hole 80. Holes 80 may be formed by drilling or casting, or by any other process known in the art. Hole 80 may, in some cases, be threaded, or may carry a threaded insert, to accommodate a cooperating set screw or the like. Thus, through use of hole 80, or a plurality thereof, in association with one or more cooperating pins, screws, bolts, or the like, bollard covering 100 may be secured to post P.

Turning now to alternative embodiments of a bollard covering of the present invention, FIGS. 2A-D and FIGS. 3A-C are next described. Except as specifically contrasted herein, the details of design, construction, use, and application of the alternative embodiments depicted in these FIGS. 2A-D and FIGS. 3A-C are as described hereinabove with reference to the preferred embodiment depicted in FIGS. 1A-D.

In FIGS. 2A-D, bollard covering 200 comprises body 20. Joined to body 20 at an upper end is body connector 30. Joined to body connector 30 is first center 40. Joined to first center 40 is second center 50. Joined to second center 50 is top 260. Similarly, joined to body 20 at a lower end is bottom 70. As will be appreciated by one of ordinary skill in the art, the primary difference between bollard covering 100 of FIGS. 1A-D and bollard covering 200 of FIGS. 2A-D is found in top 260. In this alternative embodiment, bollard covering 200 is provided with domed top 260, in lieu of flat top 60 as was shown in association with bollard covering 100.

Figure 3B:
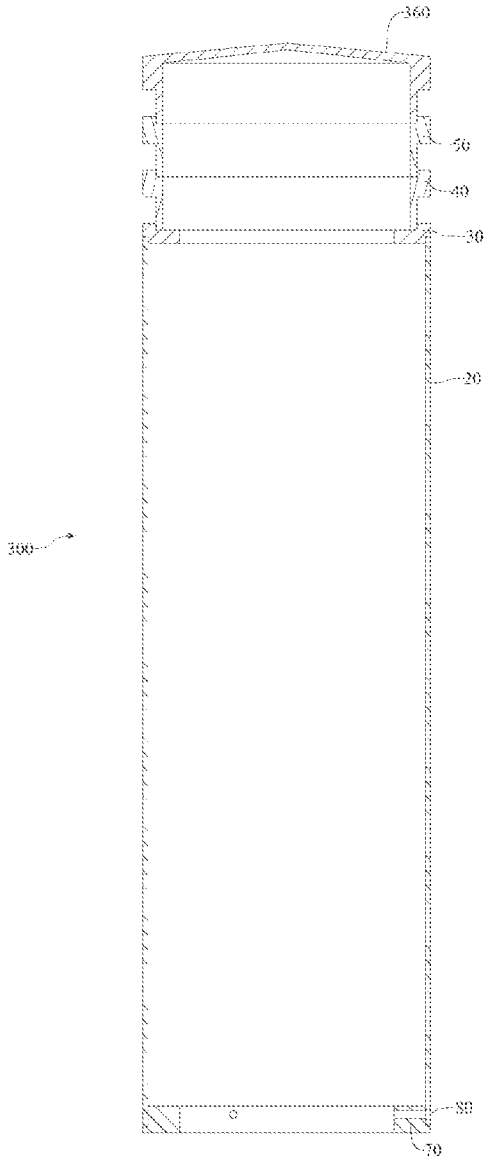
FIG. 3B depicts a sectional view of the embodiment of FIG. 3A taken at section C-C.
Figure 3A:
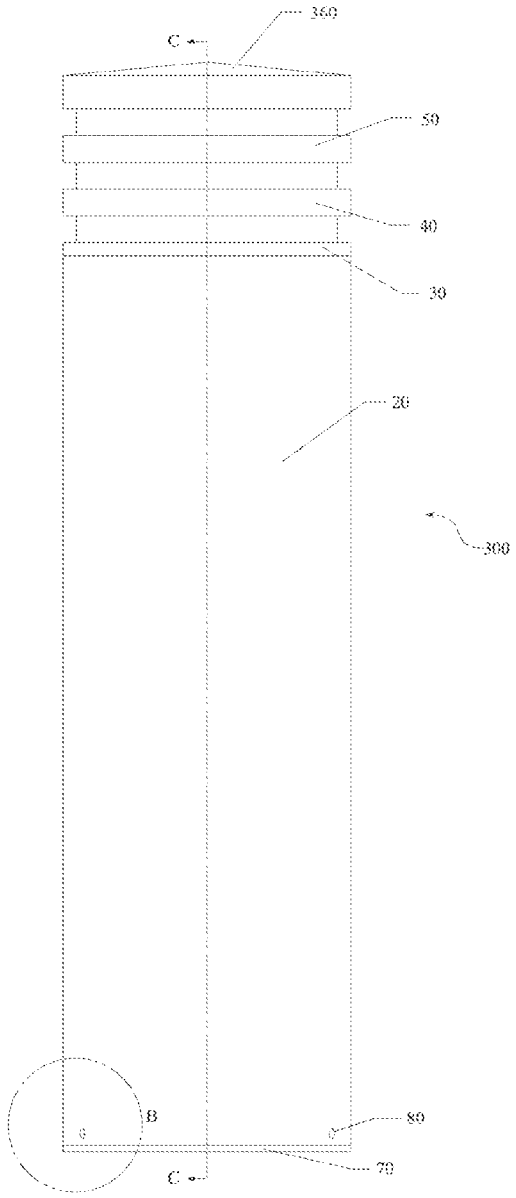
FIG. 3A depicts a side elevation view of a third embodiment of the present invention.
Figure 3C:
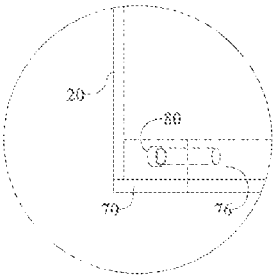
FIG. 3C depicts a sectional view of the embodiment of FIG. 3A taken at section B.

In FIGS. 3A-C, bollard covering 300 comprises body 20. Joined to body 20 at an upper end is body connector 30. Joined to body connector 30 is first center 40. Joined to first center 40 is second center 50. Joined to second center 50 is top 360. Similarly, joined to body 20 at a lower end is bottom 70. As will be appreciated by one of ordinary skill in the art, the primary difference between the previously described embodiments and bollard covering 300 of FIGS. 3A-C is found in top 360. In this alternative embodiment, bollard covering 300 is provided with peaked or pointed top 360, in lieu of flat top 60 or domed top 260 of the previously described embodiments.

Thus, it will be apparent that bollard coverings of the present invention may be provided with tops comprising pyramidal, round, domed, spherical, flat, or other geometric or decorative shapes; or with functional tops, such as T-tops for affixing tape for delineation of motorways, pedestrian walkways, or the like. All such alternative configurations are contemplated as being adaptable to the bollard coverings of the present invention.

Turning now to another alternative embodiment of a bollard covering of the present invention, FIGS. 4A-D are next described. Except as specifically contrasted herein, the details of design, construction, use, and application of the alternative embodiments depicted in these FIGS. 4A-D are as described hereinabove with reference to the preferred embodiment depicted in FIGS. 1A-C.

In FIGS. 4A-D, bollard covering 400 comprises body 420. Joined to body 420 at an upper end is body connector 430. Joined to body connector 430 is first center 440. Joined to first center 440 is second center 450. Joined to second center 450 is top 460. Similarly, joined to body 420 at a lower end is bottom 470.

Figure 1A:
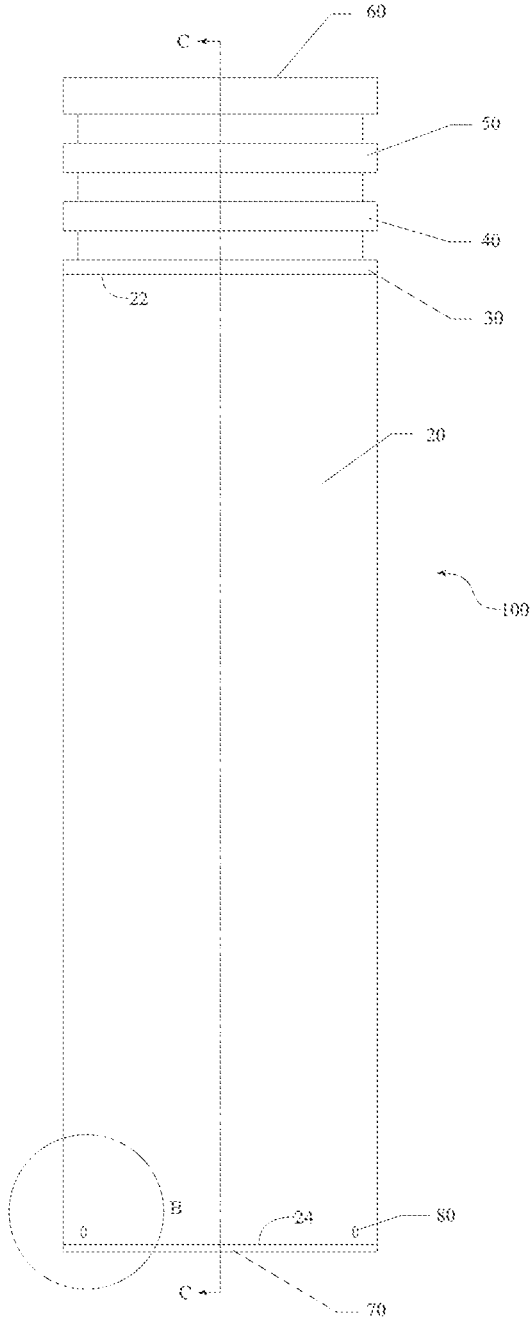
FIG. 1A depicts a side elevation view of a first embodiment of the present invention.
Figure 1C:
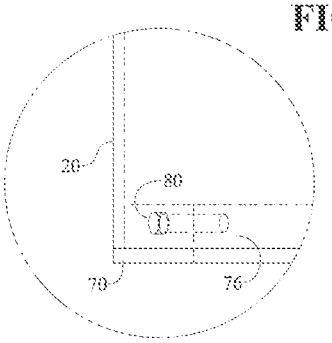
FIG. 1C depicts a sectional view of the embodiment of FIG. 1A taken at section B.
Figure 1D:
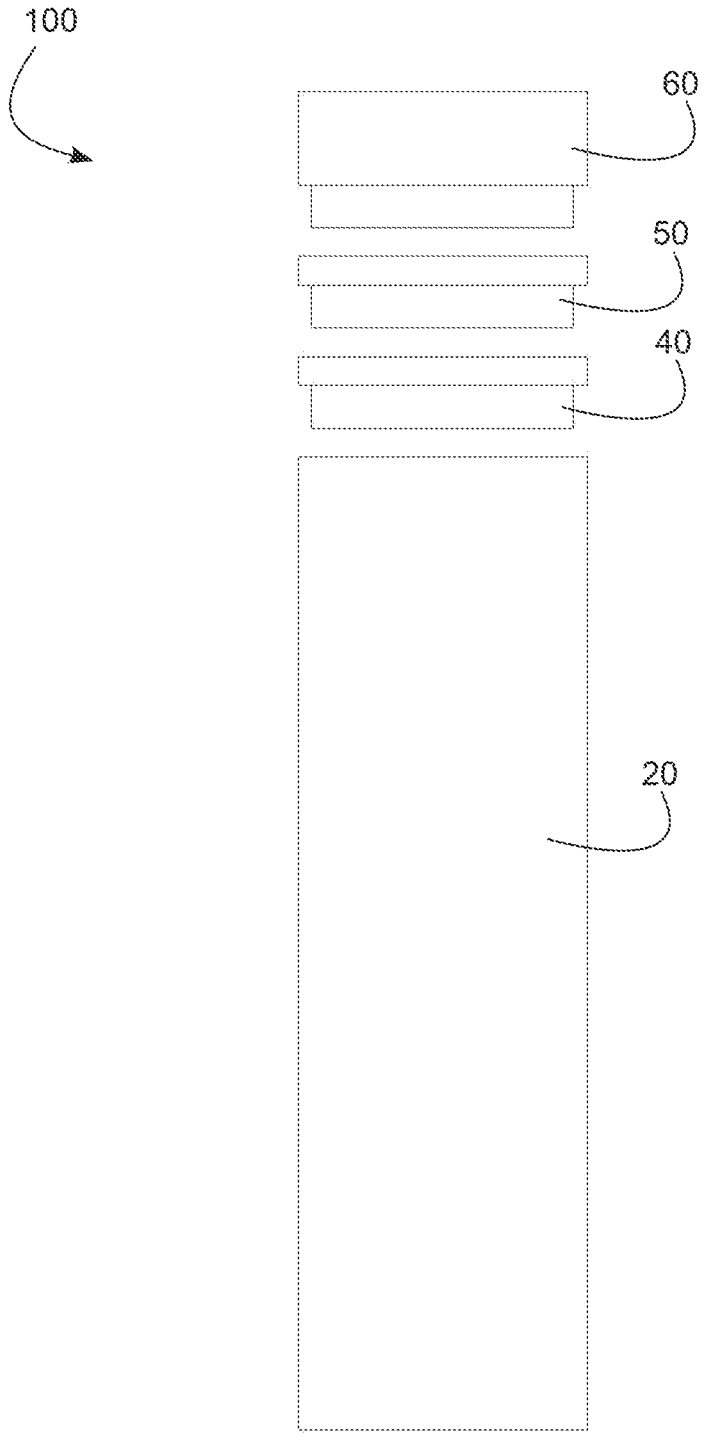
FIG. 1D depicts a partial exploded view of the embodiment of FIG. 1A.
Figure 2B:
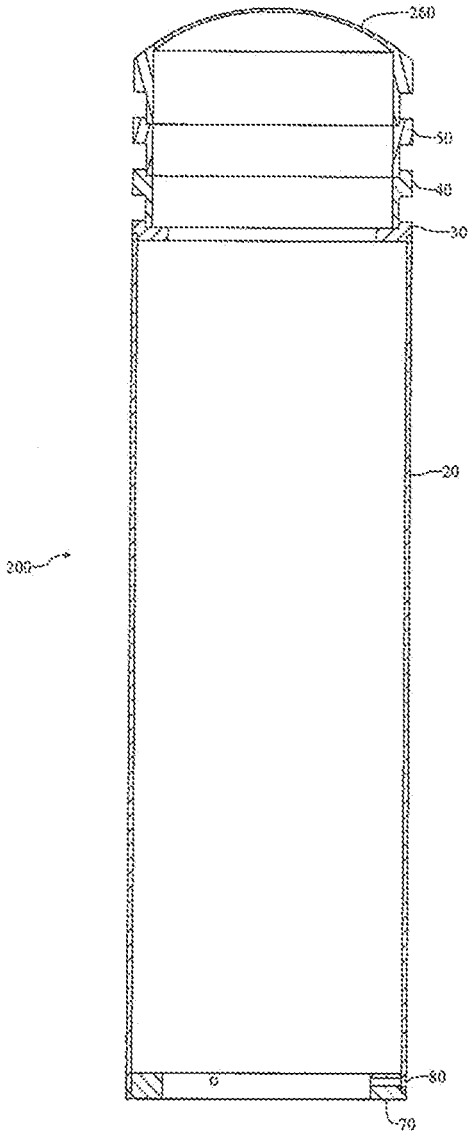
FIG. 2B depicts a sectional view of the embodiment of FIG. 2A taken at section C-C.
Figure 2A:
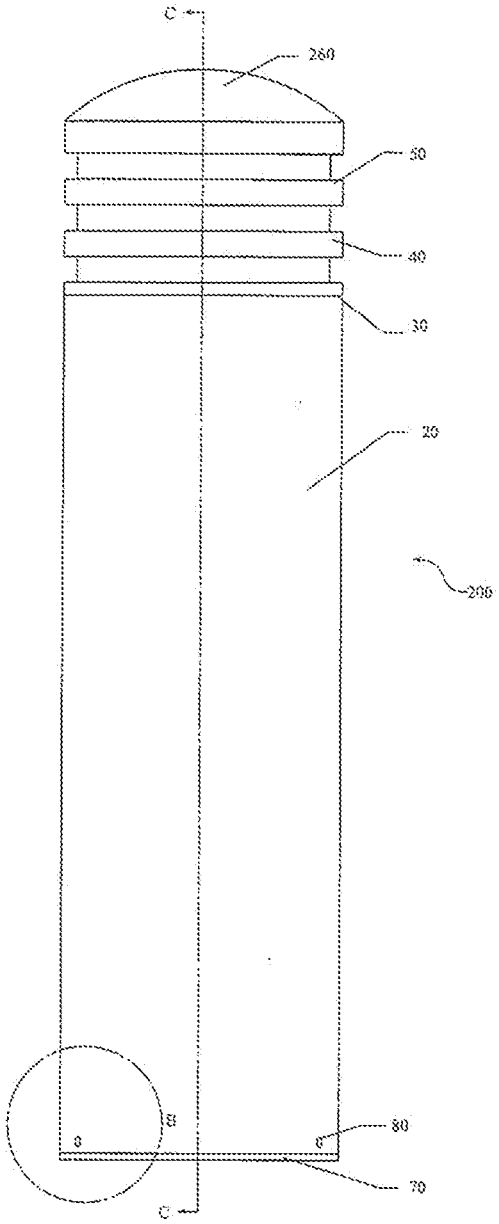
FIG. 2A depicts a side elevation view of a second embodiment of the present invention.
Figure 2C:
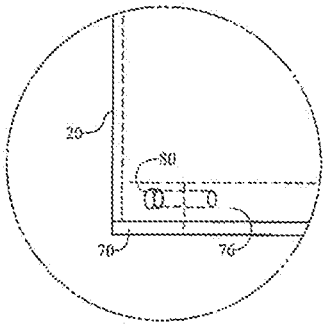
FIG. 2C depicts a sectional view of the embodiment of FIG. 2A taken at section B.
Figure 2D:
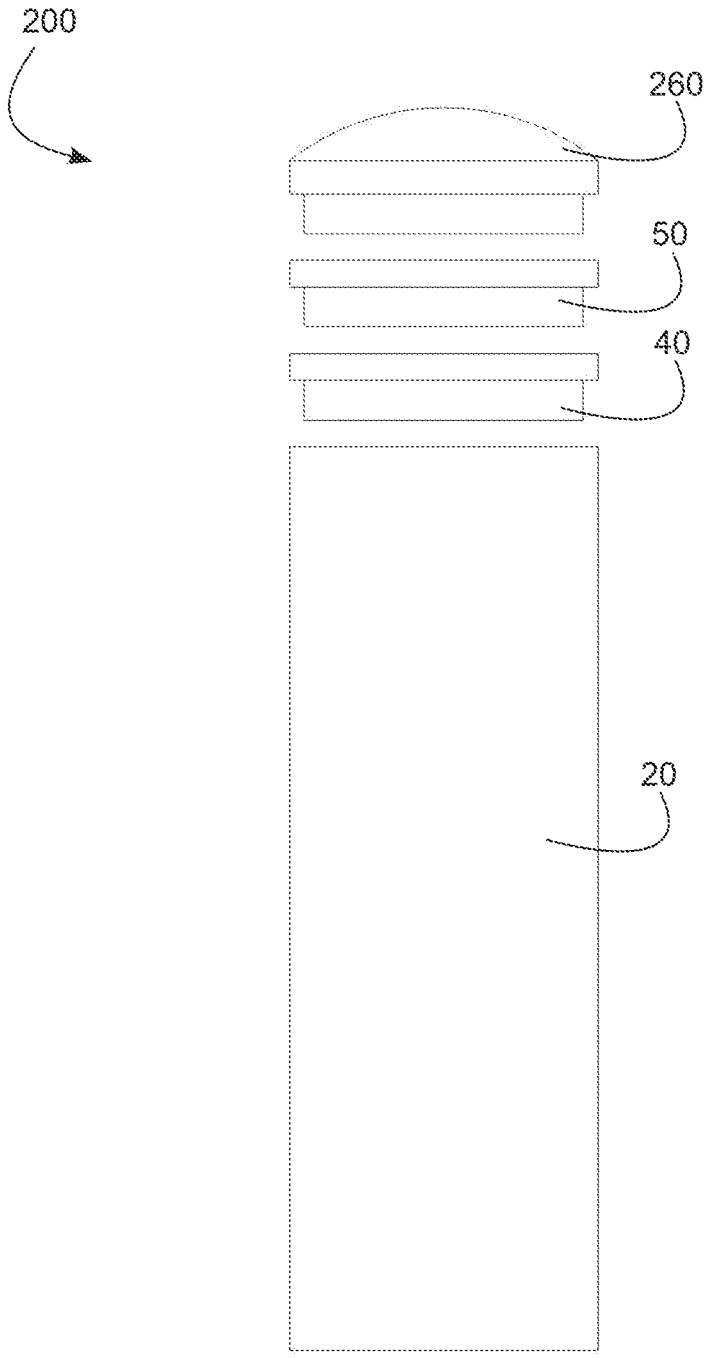
FIG. 2D depicts a partial exploded view of the embodiment of FIG. 2A.
Figure 4D:
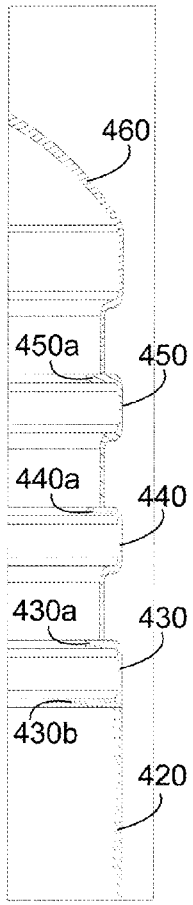
FIG. 4D depicts a sectional view of the embodiment of FIG. 4A taken at section D.
Figure 4A:
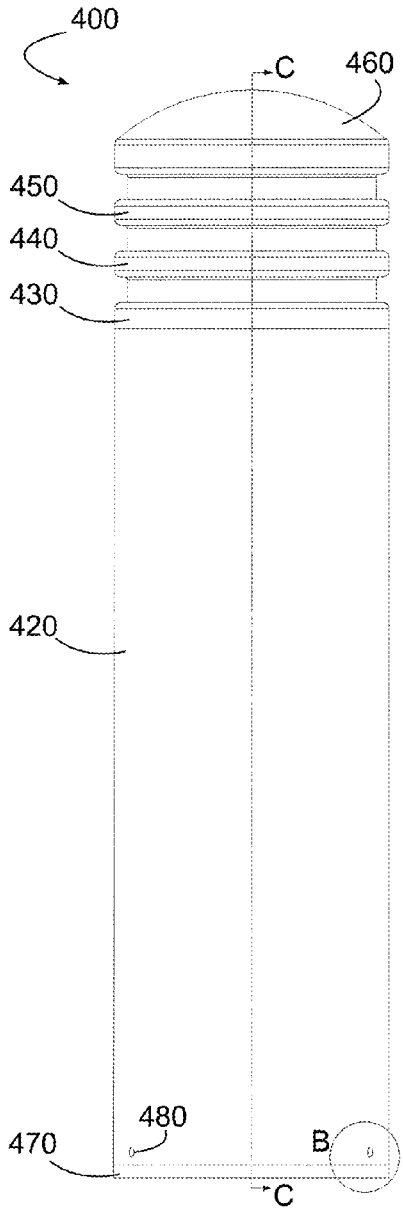
FIG. 4A depicts a side elevation view of a fourth embodiment of the present invention.
Figure 4B:
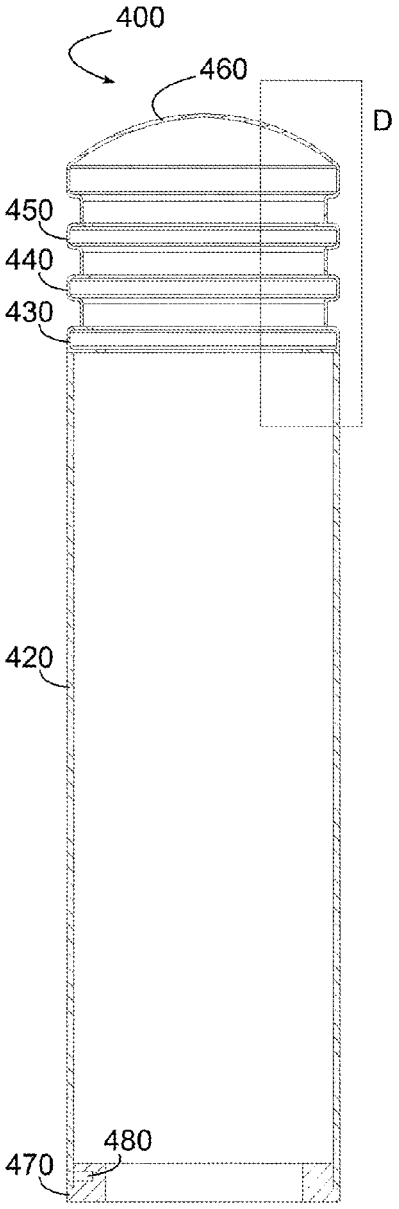
FIG. 4B depicts a sectional view of the embodiment of FIG. 4A taken at section C-C.
Figure 4C:
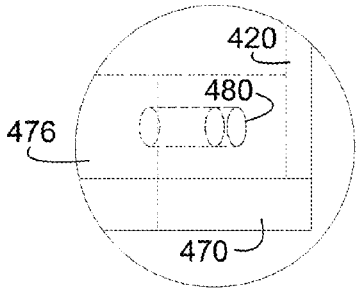
FIG. 4C depicts a sectional view of the embodiment of FIG. 4A taken at section B.

As will be appreciated by one of ordinary skill in the art, the primary difference between bollard covering 400 of FIGS. 4A-D and bollard covering 100 of FIGS. 1A-C is found in the alternative form of construction of certain component pieces; to wit, body connector 430, first center 440, second center 450, and top 460, the details of which are of best seen with reference to FIG. 4D. In this alternative embodiment, body connector 430, first center 440, second center 450, and top 460 are provided with a construction such that each successive said piece rests upon a flat surface on, or formed within, the piece below. In embodiments wherein each successive said piece rests upon a flat surface formed within the piece below, a groove, seat, or depression, for example, may be formed within the flat surface of the piece below, providing means for locating a bottom edge of the piece above. Each said piece may be affixed to the one below by welding, bonding, adhesives, mechanical fastening, or the like. In some embodiments, extension edges 430*a*, 430*b*, 440*a*, 450*a* in selected pieces, may be bent upwardly and/or downwardly, in tab or ring-like configuration, to receive the adjoining piece(s) above and/or below, and to provide an adjacent surface to which bonding or other forms of affixation may be accomplished and/or improved.

Now that the basic design, structure, and relationship of the various elements of bollard coverings 100, 200, 300, 400 have been described above in detail, various methods of joining and fabricating said various elements into a bollard covering product of the present invention will be described.

All such variants are hereby specifically contemplated as part of the inventive subject matter herein.

As was described, body 20, 420, body connector 30, 430, first center 40, 440, second center 50, 450, alternative tops 60, 260, 360, 460, and bottom 70, 470 are preferably prefabricated elements comprising metal, plastic, concrete, fiberglass, or composites, as dictated by design, use, and/or application. As may be better understood by reference to the exploded views of FIGS. 1D and 2D, the method of the present invention contemplates that such elements may be modular and may be selected from a manufacturer's standard inventory parts, brought together in stackable form, and joined by simple and relatively inexpensive secondary operations, such as welding, bonding, mechanical fastening (including, without limitation, screws, screw and/or threaded elements, frictional, compression, and/or press-fit elements, adhesives and/or adhesive elements, weldments, bolts and nuts, pins, threaded collars and/or cooperating threaded recesses, interlocking tab and slot arrangements, interlocking mechanical element and slot arrangements, and the like), and other known forms of joining together cooperating mechanical elements, from a manufacturer's standard inventory elements, in order to create a standard inventory or a customized bollard covering product that may be economically configured on an individual bollard covering basis, or on small or large scale runs, with as much variation in optional components, features, and conveniences as may be required by the marketplace, and without excessive setup or secondary machining/processing costs associated with bollard covering manufacturing processes for an individual bollard covering product, or with runs of a particular bollard covering product.

More particularly, and with reference to FIGS. 5A through 9C, inclusive, bollard coverings 500, 600, 700, 800, 900 depict further illustrative aspects of construction and element joinder for those respective alternative embodiments. Generally, FIGS. 5A-5C depict joinder of one or more of body, body connector, centers, top, and bottom elements via, e.g., a frictional, compression, and/or press-fit-type connection. Generally, FIGS. 6A-6C depict joinder of one or more of body, body connector, centers, top, and bottom elements via, e.g., a tabbed-type connection. Generally, FIGS. 7A-7C depict joinder of one or more of body, body connector, centers, top, and bottom elements via, e.g., a clip-type connection. Generally, FIGS. 8A-8C depict joinder of one or more of body, body connector, centers, top, and bottom elements via, e.g., a lock-type connection. Generally, FIGS. 9A-9C depict joinder of one or more of body, body connector, centers, top, and bottom elements via, e.g., a thread-type connection. Additional details of each type of joinder will be described below.

In FIGS. 5A-5C, inclusive, one or more of body, body connector, centers, top, and bottom elements (as described in greater detail hereinabove) are shown as joined via, e.g., a frictional, compression, and/or press-fit-type connection. Exemplary of such frictional, compression, and/or press-fit-type connections, one such connection 590 is best seen by reference to FIG. 5C. In forming connection 590, one or both of the cooperating elements being so joined are sized, dimensioned, toleranced, and/or processed so as to engage in an interference fit. As such term is known in the mechanical arts, an interference fit between two cooperating elements may be described as one in which an external dimension of one element slightly exceeds an internal dimension of the element into which it is intended to fit. Such an interference fit may be achieved by machining, application of pressure, thermal treatment of one or both cooperating elements so as to result in expansion and/or contraction of one element within or about another, and the like, so that connection 590, characteristic of this form of connection, results. In some applications, additional reinforcement of connection 590 may be achieved by line and/or spot welding, adhesives, tapes, drive pins, screws or bolts, and/or the like.

In FIGS. 6A-6C, inclusive, one or more of body, body connector, centers, top, and bottom elements (as described in greater detail hereinabove) are shown as joined via, e.g., a tabbed-type connection. Exemplary of such tabbed-type connections, one such connection 690 is best seen by reference to FIG. 6C. In forming connection 690, one of the cooperating elements is formed so as to provide one or more tab 692. The other of the cooperating elements is formed so as to provide one or more slot 694. Slot 694 is dimensioned and located so as to receive tab 692 therewithin. As joined, corresponding tab 692 and slot 694 together form a coincident pair. It will be recognized that each cooperating tab 692 and slot 694 may be located peripherally upon its respective element. Alternatively, each cooperating tab 692 and slot 694 may be located and/or disposed at selected positions across or along facing surfaces of their respective elements. In some embodiments, tab 692 may be formed as a spline and slot 694 may be formed as a groove for receiving a corresponding spline. In some applications, additional reinforcement of connection 690 may be achieved by line and/or spot welding, adhesives, tapes, drive pins, screws or bolts, and/or the like.

In FIGS. 7A-7C, inclusive, one or more of body, body connector, centers, top, and bottom elements (as described in greater detail hereinabove) are shown as joined via, e.g., a clip-type connection. Exemplary of such clip-type connections, one such connection 790 is best seen by reference to FIG. 7C. In forming connection 790, one of the cooperating elements is formed so as to provide one or more clip 792. The other of the cooperating elements is formed so as to provide one or more recess 794. Recess 794 is dimensioned and located so as to receive clip 792 therewithin. As joined, corresponding clip 792 and recess 794 together form a coincident pair. It will be recognized that each cooperating clip 792 and recess 794 may be located peripherally upon its respective element. Alternatively, each cooperating clip 792 and recess 794 may be located and/or disposed at selected positions across or along facing surfaces of their respective elements. In some embodiments, clip 792 may be characterized as comprising a ramped portion 796 and recess 794 may be characterized as comprising an inclined recess 798 for receiving a corresponding ramped portion of clip 792. In some applications, additional reinforcement of connection 790 may be achieved by line and/or spot welding, adhesives, tapes, drive pins, screws or bolts, and/or the like.

In FIGS. 8A-8C, inclusive, one or more of body, body connector, centers, top, and bottom elements (as described in greater detail hereinabove) are shown as joined via, e.g., a lock-type connection. Exemplary of such lock-type connections, one such connection 890 is best seen by reference to FIG. 8C. In forming connection 890, one of the cooperating elements is formed so as to provide one or more lock 892. The other of the cooperating elements is formed so as to provide one or more slot 894. Slot 894 is dimensioned and located so as to receive lock 892 therewithin. As joined, corresponding lock 892 and slot 894 together form a coincident pair. It will be recognized that each cooperating lock 892 and slot 894 may be located peripherally upon its respective element. Alternatively, each cooperating lock 892 and slot 894 may be located and/or disposed at selected positions across or along facing surfaces of their respective elements. In some embodiments, lock 892 may be characterized as comprising a tab, a pin, an L-shaped or T-shaped hook, a threaded element, or the like, and slot 894 may be characterized as comprising an L-shaped or T-shaped slot for receiving a cooperating form of lock 892. In some applications, additional reinforcement of connection 890 may be achieved by line and/or spot welding, adhesives, tapes, drive pins, screws or bolts, and/or the like.

In FIGS. 9A-9C, inclusive, one or more of body, body connector, centers, top, and bottom elements (as described in greater detail hereinabove) are shown as joined via, e.g., a thread-type connection. Exemplary of such thread-type connections, one such connection 990 is best seen by reference to FIG. 9C. In forming connection 990, one of the cooperating elements is formed so as to provide one or more male thread 992. The other of the cooperating elements is formed so as to provide one or more female thread 994. Female thread 994 is dimensioned and located so as to receive male thread 992 therewithin. As joined, corresponding male thread 992 and female thread 994 together form a coincident pair. It will be recognized that each cooperating male thread 892 and female thread 894 may be located peripherally upon its respective element. Alternatively, each cooperating male thread 992 and female thread 994 may be located and/or disposed at selected positions across or along facing surfaces of their respective elements. In some embodiments, male thread 992 may be characterized as comprising a threaded collar, or the like, and female thread 994 may be characterized as comprising a cooperating threaded recess, within or without a respective collar, for receiving a cooperating form of male thread 992. In some applications, additional reinforcement of connection 990 may be achieved by line and/or spot welding, adhesives, tapes, drive pins, screws or bolts, and/or the like.

It will be further apparent and appreciated that, in some embodiments, any number of centers may be selected, brought together in stackable form, and joined to comprise a bollard cover of the present invention. In some embodiments, a single center may comprise a plurality of reveals and/or accents. In other embodiments, no centers need be provided at all.

In further embodiments, one or more body, body connector, first center, second center, top, and bottom element may be consolidated or combined to form alternatively constructed, prefabricated, modular, stackable elements, as dictated by design, use, and/or application.

In any such further embodiments, one or more body, body connector, first center, second center, top, and bottom element may be joined according to one or more of the means of joinder depicted in FIGS. 5A-9C.

In yet further embodiments, an impact-rated bollard cover 100, 200, 300, 400, 500, 600, 700, 800, 900 of the present invention may take stand-alone form as a bollard, without need for use of, or attachment to, post P. In such embodiments, the overall length of the bollard cover would be increased to comprise sufficient length to embed the bollard cover into an appropriate concrete base, pad, or other surface. In some such embodiments, bottom 70, 470 could be omitted to allow better penetration and affixation into the concrete base, pad, or other surface.

Thus, it can now be seen that bollard coverings of the present invention overcome at least some of the deficiencies noted in the prior art, and meet at least some of the beneficial goals of the invention by providing bollard coverings fabricated according to a unique modular design and construction. Availability of a unique modular design and construction for bollard covering products is believed to provide for greater manufacturing efficiencies, and is believed to allow an enhanced diversity and greater number of bollard covering products to be available in the marketplace. Use of such unique modular design and construction for bollard covering products is believed to allow for greater numbers of customer-required configurations and more options, greater design flexibility, and lower costs, all of which are believed to be beneficial in providing those features, functions, and uses demanded in the modern marketplace, and at a more efficient price.

It will therefore be understood that the particular embodiments of the inventive subject matter set forth and described hereinabove is provided by way of illustration only, and is in no way meant to be restrictive. Numerous changes and modifications may be made, and the full use of equivalents resorted to, without departing from the spirit or scope of the present inventive subject matter, limited only as provided in the appended claims.

What is claimed:

1. A bollard covering for overlaying a bollard post comprising:

(a.) a body, said body comprising an upper end and a lower end;

(b.) a body connector, said body connector comprising a flange surface, said flange surface joined to said upper end of said body, and at least one of a recess or an extension edge;

(c.) a center, said center comprising a lower end joined to said at least one of a recess or an extension edge of said body connector, and at least one of a recess or an extension edge;

(d.) a top, said top comprising a lower end joined to said at least one of a recess or an extension edge of said center;

(e.) said body connector, center, and top disposed within a region encompassing not more than approximately an uppermost third of said bollard covering;

(f.) a bottom, said bottom comprising a flange surface, said flange surface joined to said lower end of said body; and (g.) means for joining said body, body connector, center, top, and bottom, said means for joining being selected from the group consisting of screw faster, threaded fastener, cooperating threads, frictional fit, compression fit, press-fit, interference fit, cooperating clip and recess connection, cooperating ramp and incline connection, cooperating lock and slot connection, adhesive, tape, cooperating bolt and nut, pin, threaded collar, threaded recess, cooperating male and female thread connection, interlocking tab and slot connection, interlocking mechanical element and slot connection;

said body, body connector, center, top, and bottom comprising separate pieces together forming said bollard covering, the bollard covering providing an internal cavity configured to receive, and install over, the bollard post.

2. The bollard covering of claim 1 further comprising a second center.

3. The bollard covering of claim 1 comprising at least two centers.

4. The bollard covering of claim 1 wherein at least one of said body connector and said bottom further comprise a post guide surface, said guide surface disposed to guide and to concentrically locate said bollard covering upon a post, and to provide structural stability of the bollard covering in association with a post.

5. The bollard covering of claim 1 wherein said bottom comprises one or more hole, said hole located in such position so as to secure said bollard covering to a post, and to restrict loosening and/or removal of said bollard covering from a post.

6. A method for constructing the bollard covering of claim 1, said method comprising the steps of joining said body at an upper end thereof to said body connector, joining said body connector to said center, joining said center to said top, and joining said bottom to a lower end of said body.

7. A process for manufacturing a bollard covering for overlaying a bollard post, said process comprising the steps of:

(a.) selecting a preformed body, said body comprising an upper end and a lower end;

(b.) selecting a preformed body connector, said body connector comprising a flange surface, said flange surface joined to said upper end of said body, and at least one of a recess or an extension edge;

(c.) selecting a preformed center, said center comprising a lower end joined to said at least one of a recess or an extension edge of said body connector, and at least one of a recess or an extension edge;

(d.) selecting a preformed top, said top comprising a lower end joined to said at least one of a recess or an extension edge of said center;

(e.) selecting a preformed bottom, said bottom comprising a flange surface, said flange surface joined to said lower end of said body;

(f.) selecting one or more means for joining said preformed body, said preformed body connector, said preformed center, said preformed top, and said preformed bottom from the group consisting of screw faster, threaded fastener, cooperating threads, frictional fit, compression fit, press-fit, interference fit, cooperating clip and recess connection, cooperating ramp and incline connection, cooperating lock and slot connection, adhesive, tape, cooperating bolt and nut, pin, threaded collar, threaded recess, cooperating male and female thread connection, interlocking tab and slot connection, interlocking mechanical element and slot connection;

(g.) joining said body at said upper end thereof to said body connector;

(h.) joining said body connector to said center;

(i.) joining said center to said top;

(j.) ensuring that said body connector, center, and top are disposed within a region encompassing not more than approximately an uppermost third of said bollard covering; and, (k.) joining said bottom to said lower end of said body;

(l.) forming, in steps (g.) through (k.), said bollard covering; and (m.) ensuring that said bollard covering, so formed, provides an internal cavity sufficient for receiving, and installing over, the bollard post.

8. The method of claim 7 wherein step (c.) comprises selecting two or more preformed centers, and wherein step (g.') comprises joining said two or more centers to each other.

9. The method of claim 7 wherein at least one of said selecting steps (a.)-(e.) comprises selecting from an inventory comprising a plurality of the selected piece.

10. A modular bollard covering for overlaying a bollard post, said modular bollard covering comprising a body module, said body module comprising an upper end and a lower end; a body connector module, said body connector module comprising a flange surface, said flange surface comprising means to join to said upper end of said body module, and at least one of a recess or an extension edge; a center module, said center module comprising a lower end comprising means to join to said at least one of a recess or an extension edge of said body connector module, and at least one of a recess or an extension edge; a top module, said top module comprising a lower end comprising means to join to said at least one of a recess or an extension edge of said center module; said body connector module, center module, and top module disposed within a region encompassing not more than approximately an uppermost third of said modular bollard covering; and a bottom module, said bottom module comprising a flange surface, said flange surface comprising means to join to said lower end of said body module; said means to join being selected from the group consisting of screw faster, threaded fastener, cooperating threads, frictional fit, compression fit, press-fit, interference fit, cooperating clip and recess connection, cooperating ramp and incline connection, cooperating lock and slot connection, adhesive, tape, cooperating bolt and nut, pin, threaded collar, threaded recess, cooperating male and female thread connection, interlocking tab and slot connection, interlocking mechanical element and slot connection: said body module, body connector module, center module, top module, and bottom module joined together to produce said bollard covering, the bollard covering, so formed, providing an internal cavity configured to receive, and install over, the bollard post.

11. The modular bollard covering of claim 10 further comprising a second center module.

12. The modular bollard of claim 10 comprising at least two center modules.

13. The modular bollard covering of claim 10 wherein at least one of said body connector module and said bottom module further comprise a post guide surface, said guide surface disposed to guide and to concentrically locate said modular bollard covering upon a post, and to provide structural stability of the modular bollard covering in association with the post.

14. The modular bollard covering of claim 10 wherein said bottom module comprises one or more hole, said hole located in such position so as to secure said modular bollard covering to a post, and to restrict loosening and/or removal of said modular bollard covering from the post.

15. A method for constructing the modular bollard covering of claim 10, said method comprising the steps of joining said body module at an upper end thereof to said body connector module, joining said body connector module to said center module, joining said center module to said top module, and joining said bottom module to a lower end of said body module.

16. A modular bollard covering for overlaying a bollard post, said modular bollard covering comprising a body module, said body module comprising an upper end and a lower end; a body connector module, said body connector module comprising a flange surface, said flange surface comprising means to join to said upper end of said body module, and at least one of a recess or an extension edge; a top module, said top module comprising a lower end comprising means to join to said at least one of a recess or an extension edge of said body connector module; said body connector module and top module disposed within a region encompassing not more than approximately an uppermost third of said modular bollard covering; and a bottom module, said bottom module comprising a flange surface, said flange surface comprising means to join to said lower end of said body module; said body module, body connector module, top module, and bottom module joined together to produce said bollard covering, the bollard covering, so formed, providing an internal cavity configured to receive, and install over, the bollard post; said means for joining selected from the group consisting of screw faster, threaded fastener, cooperating threads, frictional fit, compression fit, press-fit, interference fit, cooperating clip and recess connection, cooperating ramp and incline connection, cooperating lock and slot connection, adhesive, tape, cooperating bolt and nut, pin, threaded collar, threaded recess, cooperating male and female thread connection, interlocking tab and slot connection, interlocking mechanical element and slot connection.

17. The modular bollard of claim 16 further comprising at least one center module comprising said means for joining between said body connector module and said top module.

* * * * *